US005899106A

United States Patent [19]

Heurteboust et al.

[11] Patent Number: 5,899,106

[45] Date of Patent: May 4, 1999

[54] PROCESS FOR MANUFACTURING A SHAPED METAL CAN

[75] Inventors: Gerard Heurteboust, Roussy le Village; Jean-Francois Secondé, Metz; Stephane Tref, Rurnage les Thionville, all of France

[73] Assignee: Sollac, Puteaux, France

[21] Appl. No.: 08/618,893

[22] Filed: Mar. 20, 1996

[30] Foreign Application Priority Data

Mar. 21, 1995 [FR] France ..... 95 03288

[51] Int. Cl.[6] ..... B21D 51/26

[52] U.S. Cl. ..... 72/370.24; 72/379.4

[58] Field of Search ..... 72/367, 370, 379.4, 72/370.24; 413/1, 69

[56] References Cited

U.S. PATENT DOCUMENTS

| | | | |
|---|---|---|---|
| 877,077 | 1/1908 | Hardie | 72/367 |
| 3,247,581 | 4/1966 | Pellizzari | 72/367 |
| 4,331,014 | 5/1982 | Miller et al. | 72/94 |
| 5,022,254 | 6/1991 | Kramer . | |

FOREIGN PATENT DOCUMENTS

| | | |
|---|---|---|
| 0 094 344 | 11/1983 | European Pat. Off. . |
| 0 543 695 | 5/1993 | European Pat. Off. . |
| 2 667 521 | 4/1992 | France . |
| 2 061 109 | 6/1971 | Germany . |
| 2 224 965 | 5/1990 | United Kingdom . |

*Primary Examiner*—Lowell A. Larson
*Attorney, Agent, or Firm*—Oblon, Spivak, McClelland, Maier & Neustadt, P.C.

[57] ABSTRACT

A process for manufacturing a shaped metal can comprising, on one hand, a bottom (1), a cylindrical peripheral wall (2) in one piece with the bottom (1) and including at least one geometrically expanded region (2A, 2A) and, on the other hand, a lid crimped or seamed on the peripheral wall (2). The process comprises effecting in the region to be geometrically expanded a controlled folding in the form of folds of an accordion of the peripheral wall (2) an on the whole of the height of the region to be geometrically expanded to increase the volume of the metal available in this region, and unfolding the accordion folds of the peripheral wall to obtain a geometrically expanded region (2A, 2B).

14 Claims, 6 Drawing Sheets

PROCESS FOR MANUFACTURING A SHAPED METAL CAN

Figure 1:
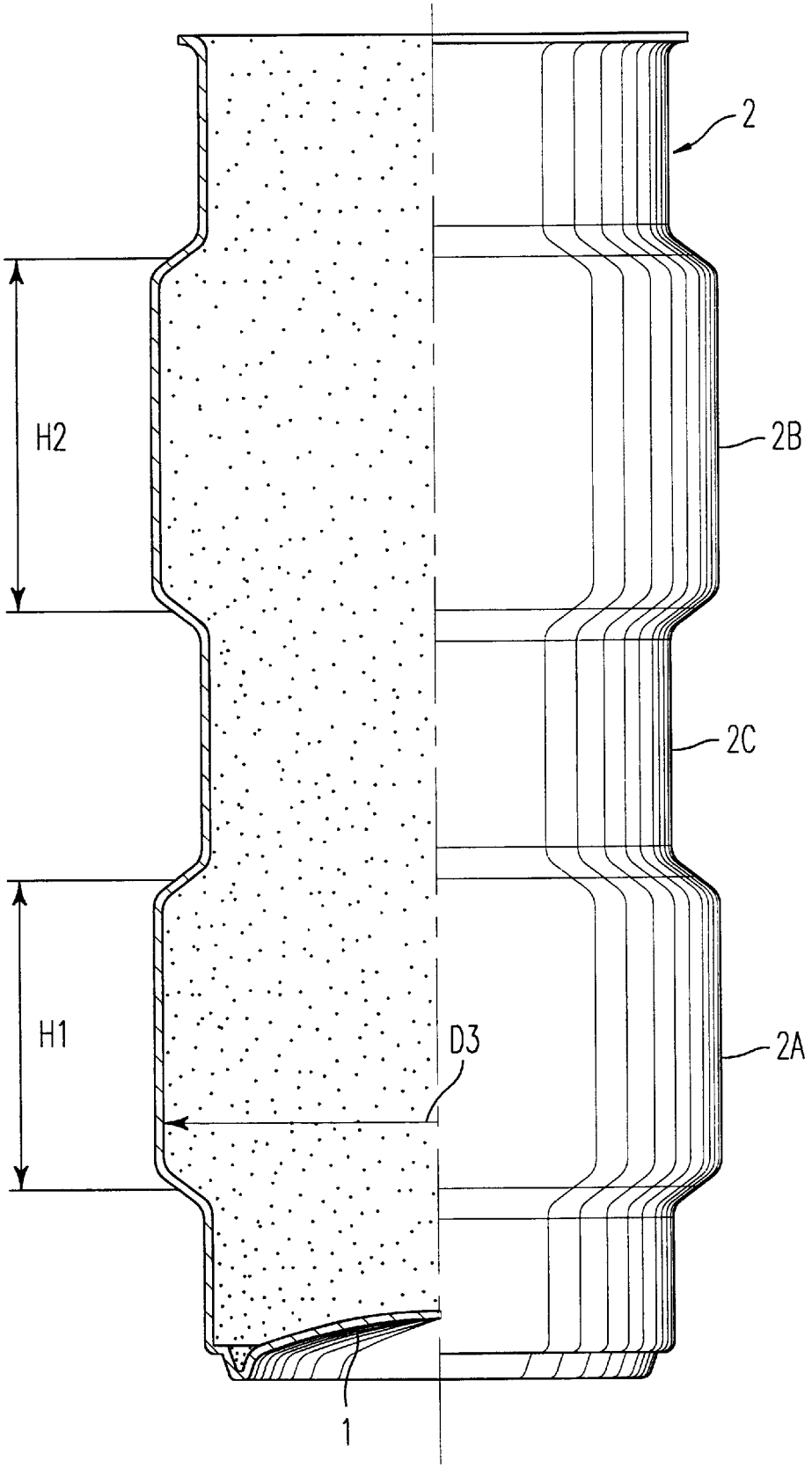

The present invention relates to process for manufacturing a shaped metal can, of the beverage can or food can type, and more particularly a shaped metal can comprising, on one hand, a bottom and a cylindrical peripheral wall in one piece with said bottom and including at least one geometrically expanded region and, on the other hand, a lid crimped or seamed on the peripheral wall.

It is known to produce shaped metal cans comprising a peripheral wall having at least one geometrically expanded region, a bottom crimped or seamed on one end of the peripheral wall and a lid crimped or seamed on the other end of the peripheral wall.

The lid is provided for example with an easily opened device opened by rupture of a line of reduced strength or for example with a tapped neck for receiving a screwed stopper.

The peripheral wall of this type of metal can is formed by ac cylindrical sleeve which is welded longitudinally and includes at least one geometrically expanded region.

Usually, the peripheral wall is produced from a metal blank of soft steel having a low carbon content and a yield strength of about 250 MPa.

A soft steel of this type permits achieving without much difficulty a local expansion of the welded cylindrical sleeve with an expansion ratio, calculated from the formula:

$$\frac{\text{final } D - \text{initial } D}{\text{initial } D} \times 100$$

which may be as much as 20%, the initial D being the initial diameter of the welded sleeve and the final D the diameter of the welded peripheral wall after expansion.

To manufacture this type of shaped can, the welded sleeve is produced, the sleeve is locally expanded to obtain a peripheral wall comprising at least one geometrically expanded region, and a bottom and a lid are respectively crimped or seamed on each end of the peripheral wall.

The geometrically expanded region is usually produced by effecting an overall expansion on the whole of the height of the region to be expanded, by a forming method employing air or nitrogen under pressure, by a forming method employing an incompressible fluid, or by a mechanical expanding method employing a tool having sectors.

It is also known to produce shaped metal cans which comprise, on one hand, a bottom and a peripheral wall in one piece with said bottom and, on the other hand, a lid crimped or seamed on the peripheral wall.

The bottom and the peripheral wall in one piece with this bottom are produced from a cup, cut from a metal blank or strip, either by drawing and redrawing operation or a drawing and ironing operation.

Most often, this type of metal can is produced from a steel having a very low carbon content obtained by a double reduction, i.e. by cold rolling a hot rolled strip, annealing and cold rerolling.

Such a steel undergoes a considerable work hardening in the course of the second cold rolling operation so that its yield strength is about 350 to 400 MPa.

In the case of the production of this type of can with the drawing and redrawing method, after formation of the peripheral wall, the metal is still more highly work hardened so that its yield strength within the peripheral wall is around 600 MPa.

The possible overall geometrical expansion ratio of the diameter of the peripheral wall is about 2.5%.

In the case of the production of this type of can with the drawing and ironing method, after the ironing of the peripheral wall, the metal is still more highly work hardened so that its yield strength within the peripheral wall is around, and sometimes even exceeds, 700 MPa, which imparts thereto a practically zero expansion capability.

The possible overall geometrical expansion ration of the diameter of the peripheral wall is lower than 1% and even lower than 0.5% for very this walls.

On the other hand, the advantage of such a metal can produced by the drawing and redrawing method or by the drawing and ironing method is that it permits employing very small thicknesses since the metal making up the wall is a very stiff metal with high mechanical properties, which results in light weight and low material cost.

Further, such a can is made in two parts, the bottom and the peripheral wall being in one piece, which is an advantage from an aesthetic point of view.

An object of the present invention is to provide a process for manufacturing a shaped metal can comprising a bottom and a peripheral wall in one piece with said bottom, said peripheral wall including at least one geometrically expanded region whose expansion ratio is about 3% in the case of the use of a drawing and redrawing method and about 8% in the case of the use of a drawing and ironing method.

The invention therefore provides a process for manufacturing a shaped metal can comprising, on one hand, a bottom and a cylindrical peripheral wall in one piece with said bottom and including at least one geometrically expanded region and, on the other hand, a lid crimped or seamed on the peripheral wall, characterized in that the process comprises:

effecting in the region to be geometrically expanded a controlled folding in the form of folds of an accordion of the peripheral wall on the whole of the height of said region to be expanded for increasing the volume of the metal available in said region, and unfolding said folds of an accordion of the peripheral wall for obtaining the geometrically expanded region.

According to other features of the invention:

the process comprises unfolding the folds of an accordion towards the exterior of the peripheral wall, the process comprises unfolding the folds of an accordion towards the interior of the peripheral wall, the process comprises producing on the peripheral wall at least two geometrically expanded regions by first of all forming the geometrically expanded region which is the closest to the bottom and then the geometrically expanded region which is the furthest from said bottom.

the process comprises effecting the controlled folding in the form of folds of an accordion of the peripheral wall by forming a series of grooves which are adjacent to one another by commencing in the part of the region to be geometrically expanded the closest to the bottom and ending in the part of the region to be geometrically expanded the furthest from said bottom, the depth of each groove is a function of the final diameter to be obtained in the geometrically expanded region in the region of the corresponding groove, the process comprises effecting the controlled folding in the form of folds of an accordion of the peripheral wall by forming a helical groove in commencing in the part of the region to be geometrically expanded the closest to the bottom and ending in the part of the region to be geometrically expanded the furthest from said bottom, the process comprises producing the groove generatrix by generatrix by means of a tool turning around the peripheral wall, the process comprises unfolding said folds of an accordion by blowing air or nitrogen under pressure, or by injection of an incompressible fluid under pressure, or by means of a circular tool comprising a plurality of adjacent sectors which are movable in a direction perpendicular to the axis of the shaped can, or by means of an inflatable cushion of elastomer.

Figure 2:
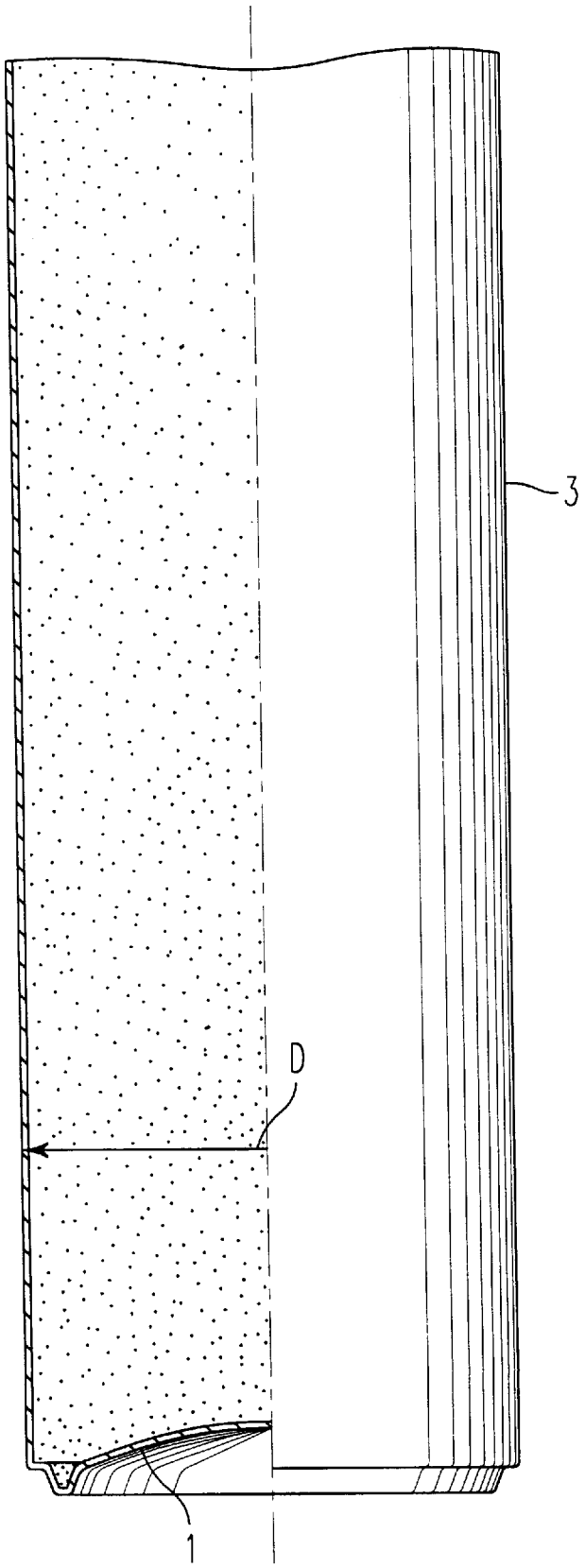
Figure 3:
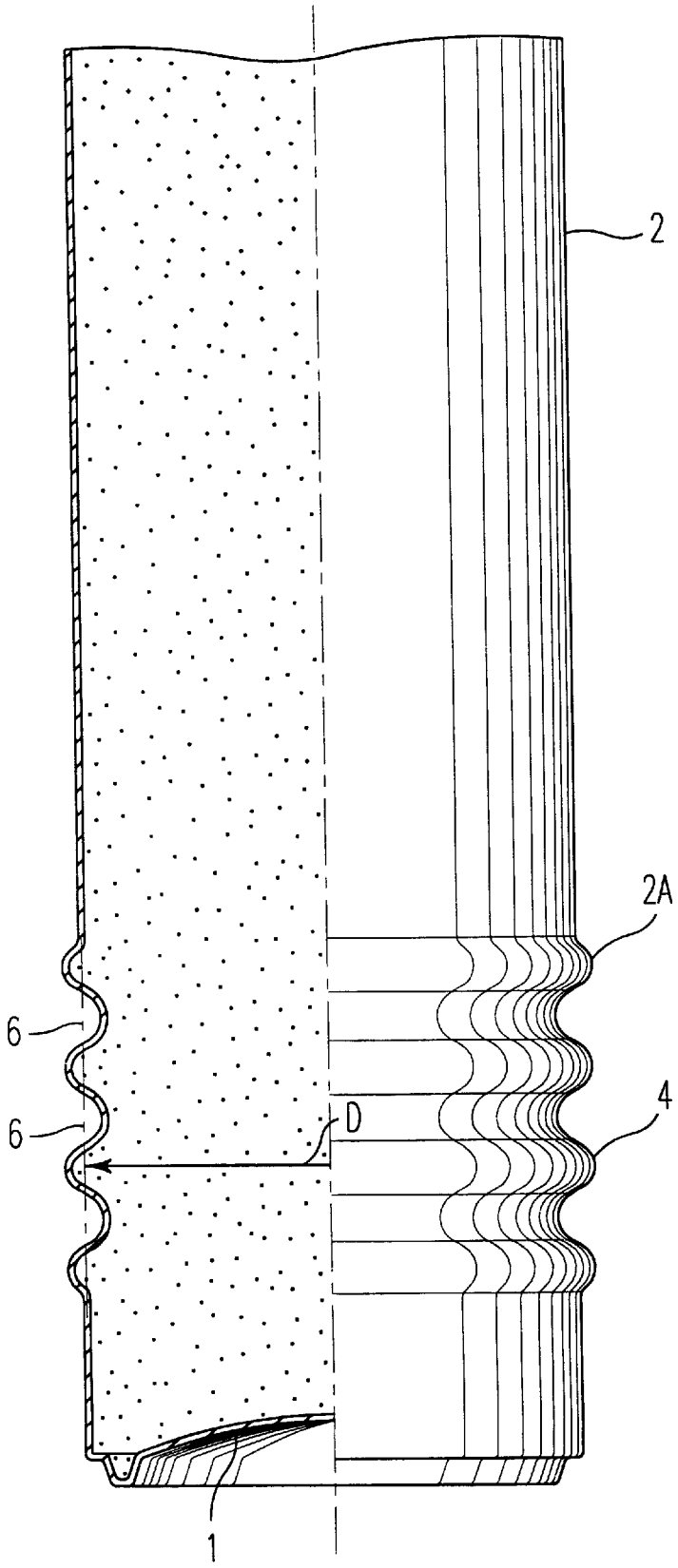
Figure 4:
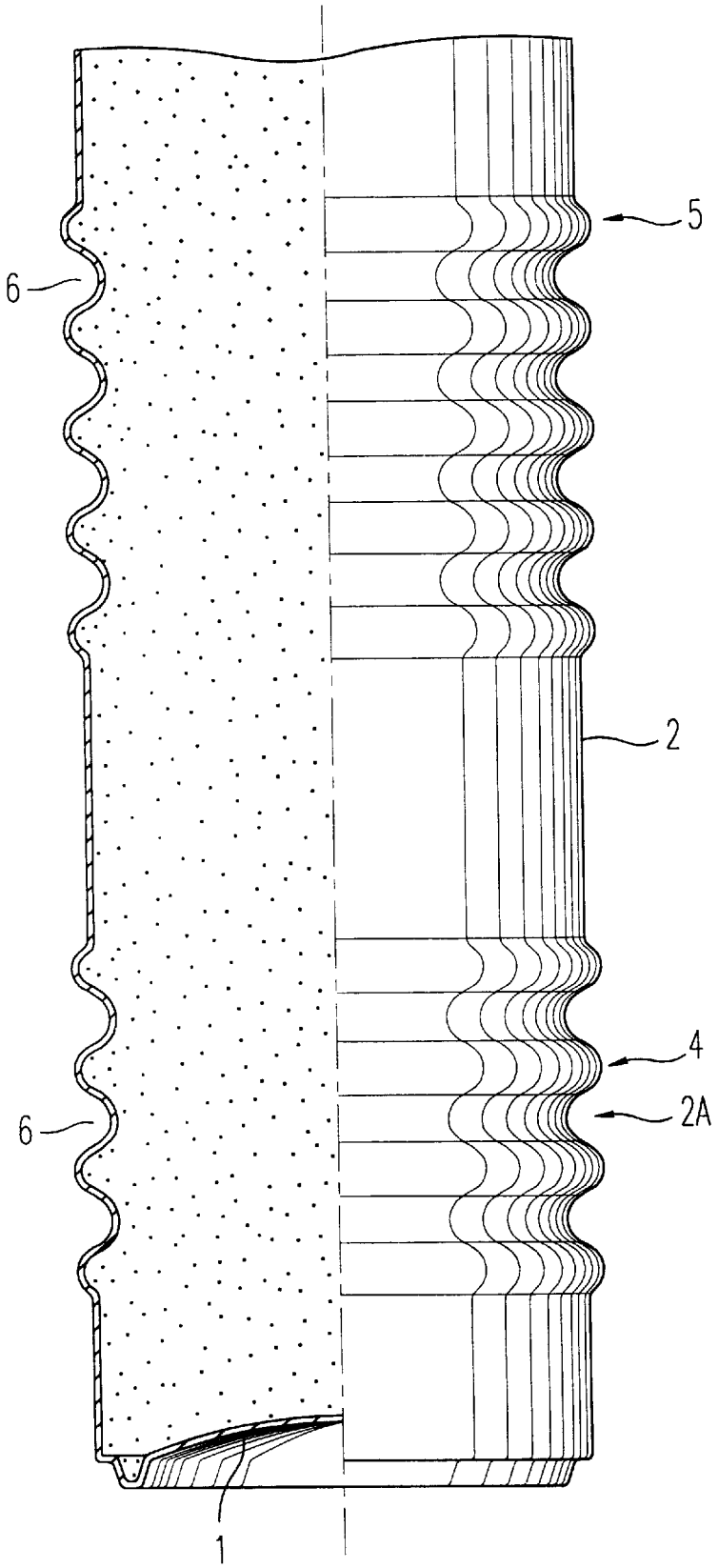
Figure 5:
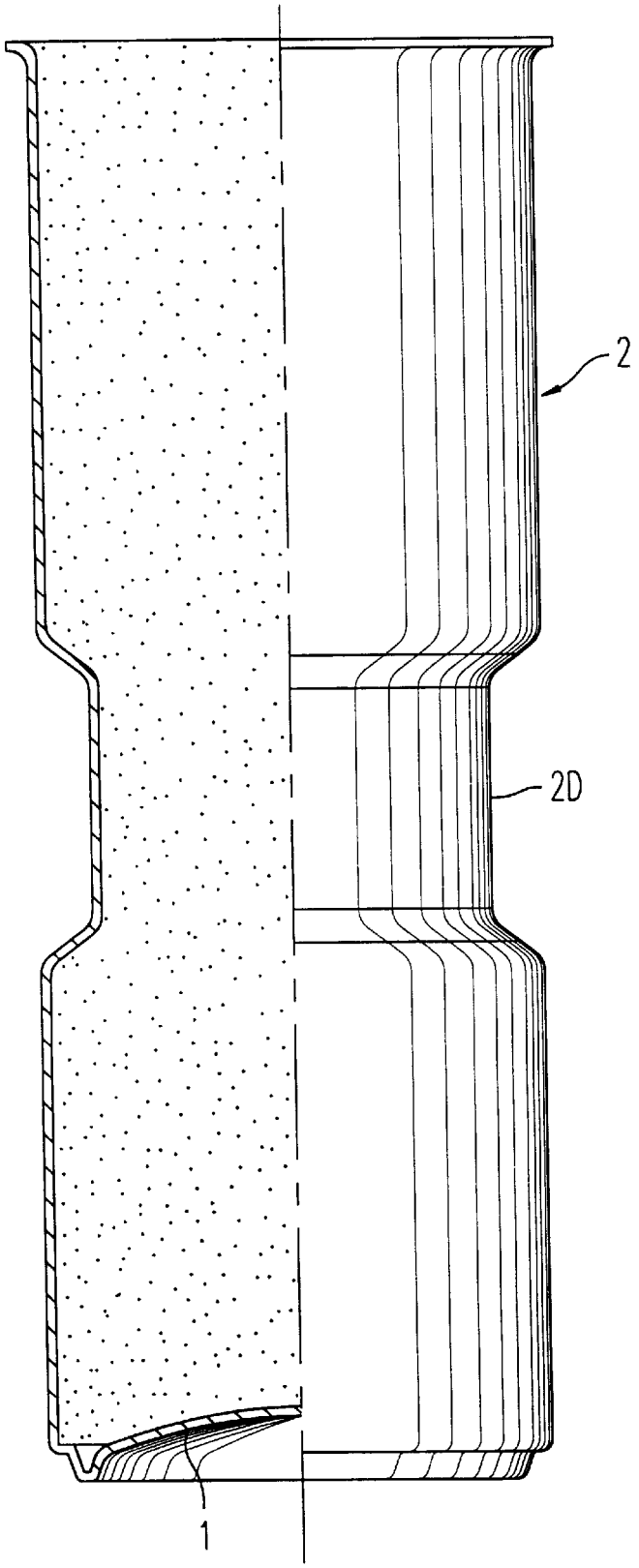
Figure 6:
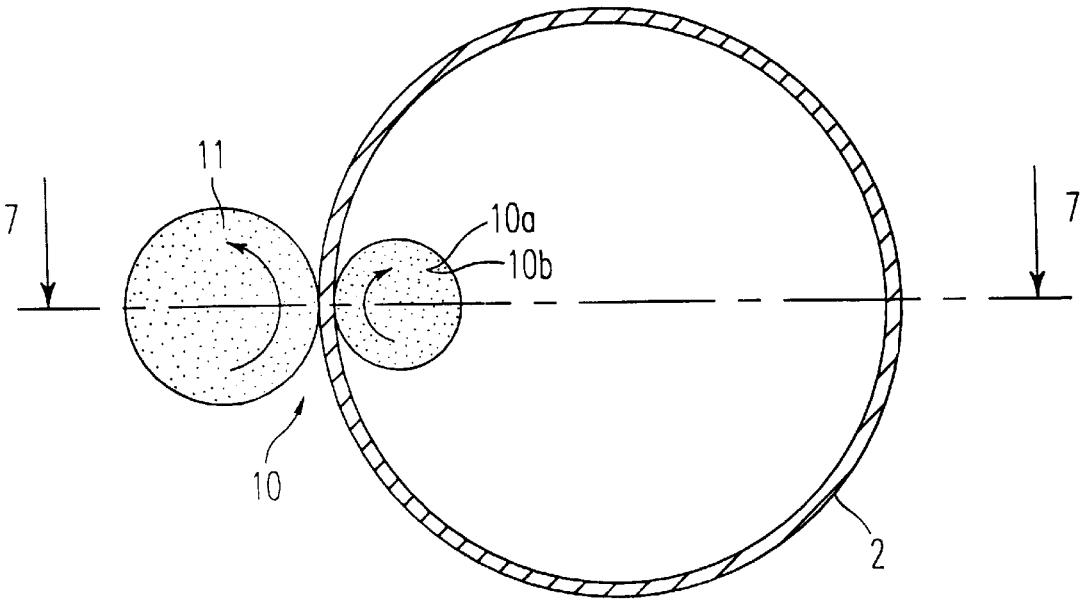
Figure 7:
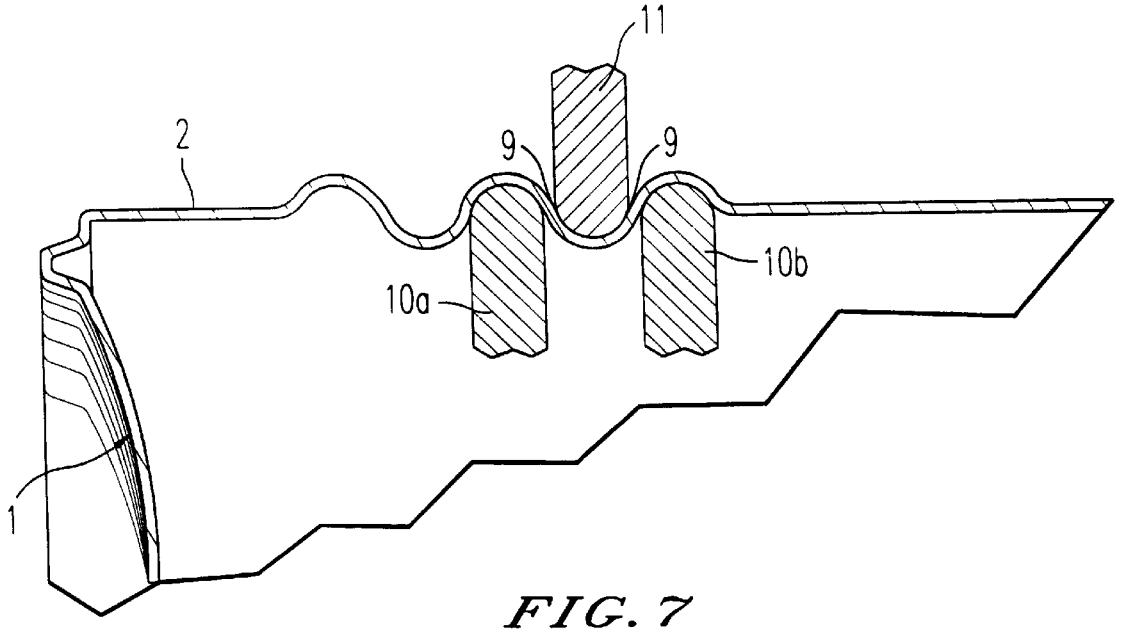

Features and advantages of the invention will be apparent from the following description given solely by way of example with reference to the accompanying drawings, in which:

FIG. 1 is a longitudinal half-sectional and half-elevational view of a first embodiment of a shaped can obtained by the process according to the invention, FIGS. 2 to 4 are longitudinal half-sectional and half-elevational views of the various steps in the process for manufacturing the shaped can of FIG. 1, FIG. 5 is a longitudinal half-sectional and half-elevational view of a second embodiment of a shaped can obtained by the process according to the invention, FIG. 6 is a diagrammatic top view of a can during its manufacture in the course of a step of the process according to the invention, FIG. 7 is a partial sectional view taken on line 7—7 of FIG. 6.

It should be noted that in these Figures, the profile of the illustrated cans has been intentionally exaggerated for reasons of clarity.

As can be seen in FIG. 1, the shaped can of the beverage can type comprises a bottom 1 and peripheral wall or skirt 2 in one piece with the bottom 1.

The peripheral wall 2 comprises for example two geometrically expanded regions, a region 2A the closest to the bottom 1 and a region 2B situated above the region 2A with respect to the bottom 1 and separated from the region 2A by an intermediate portion 2C.

The region 2A extends on a height H1 of the peripheral wall 2 of the can and the region 2B extends on a height H2 of the peripheral wall 2.

To produce such a shaped can, the process according to the invention comprises, in a first step, effecting on a preliminary can obtained by drawing and redrawing or by drawing and ironing a metal blank of steel, aluminium or aluminium alloy, such as that shown in FIG. 2, a controlled folding in the form of folds 4 of an accordion or bellows in the region 2A to be geometrically expanded and on the whole of the height H1 of said region to be expanded.

The controlled folding 4 shown in FIG. 3 has for purpose to increase the volume of metal available in the region 2A of height H1.

In a second step, there is effected in the region 2B to be geometrically expanded and on the whole of the height H2 of the region 2B, a controlled folding in the form of folds 5 of an accordion or bellows, as shown in FIG. 4.

In a third step, the accordion folds 4 and 5 produced in the preceding steps are unfolded toward the exterior of the peripheral wall 2 to rapidly obtain the geometrically expanded regions 2A and 2B.

To produce the accordion folds 4 and 5 of the peripheral wall 2, there is formed a series of grooves 6 which are adjacent to one another by commencing in the part of the region 2A to be geometrically expanded the closest to the bottom and ending in the part of the region 2A to be geometrically expanded the furthest from said bottom, and by producing first of all the grooves 6 of the region 2A the closest to the bottom and then the grooves 6 of the region 2B the furthest from the bottom.

The depth of each groove is a function of the final diameter to be obtained in each region 2A and 2B at the corresponding groove 6.

If the can to be produced has more than two regions to be geometrically expanded, the operation is commenced in the region to be expanded which is the closest to the bottom and the operation is continued in the region to be expanded situated above said region which is the closest to the bottom and so on up to the region which is the furthest from the bottom.

As shown in FIG. 6 and 7, each groove 6 formed on a ring of the peripheral wall 2 is formed generatrix by generatrix by means of a tool which turns around the peripheral wall 2 and is generally designated by the reference numeral 10.

This rotating tool 10 comprises a set of three rings having axes of rotation parallel to the axis of revolution of the can, comprising a ring 11 turning around the peripheral wall 2, outside the latter, and two rings respectively 10*a* and 10*b* which turn around the peripheral wall 2 inside the latter.

In an alternative embodiment, the rings 10*a* and 10*b* turn around the peripheral wall 2 outside the latter and the ring 11 turns around the peripheral wall 2 inside the latter.

The rings 1-*a* and 10*b* are located in superimposed planes on each side of the plane containing the ring 11.

To produce a groove 6, the tool 10 is placed against the peripheral wall 2 of the can at the desired position and the rings 10*a,* 10*b,* and 11 are made to turn around the can while causing the outer ring 11 and the inner rings 10*a* and 10*b* to interpenetrate.

In order to reach the desired depth of the groove 6, several successive operations are often necessary. In this case, after having effected a first rotation of the tool 10 around the peripheral wall 2, one or more additional rotations are effected while increasing the interpenetration of the rings 10*a,* 10*b* and 11 for each rotation.

The relative positions of the rings 10*a,* 10*b* 11 of the tool 10 forming the groove 6, and the geometry of the rings are so calculated as to, on one hand, form a groove 6 without a thinning down of the peripheral wall 2 or with a very limited thinning down of this wall and, on the other hand, optimize the free portion 9 of the generatrix of the peripheral wall 2 in contact with the rings 10*a,* 10*b,* and 11 so that this free wall portion is short enough to avoid risk of a creasing of the metal and long enough to avoid risk of a marking of the surface of the peripheral wall 2 by said rings.

In an alternative embodiment (not shown) the tool 10 comprises a set of four rings having axes of rotation parallel to the axis of revolution of the can, two rings turning around the peripheral wall 2 outside the latter and two rings turning around the interior of the peripheral wall. This configuration of the tool 10 permits avoiding the creasing when forming the groove 6 by maintaining the metal of the previously formed groove.

It is important to arrange that the formation of the grooves 6 to produce the accordion folds 4 and 5 of the regions 2A and 2B of the peripheral wall 2 of the can, occurs with no thinning down of the peripheral wall 2 or with a very limited thinning down.

This is the reason why the formation of the groove 6 starts with that of the part of the region 2A and 2B to be geometrically expanded which is the closes to the bottom 1 in order to permit the metal of the peripheral wall 2 situated above the ring on which the groove 6 is formed, to flow toward said ring during the formation of the groove 6.

During this operation, the free end of the peripheral wall 2 subjected to no axial pressure or retention force.

Indeed, it is found that, after having produced the accordion folds of the region 2A and 2B to be geometrically expanded, the total height of the preliminary can has diminished.

To obtain the unfolding of the controlled accordion folds 4 and 5 of the peripheral wall 2, there is employed for example the known method of expansion by blowing air or nitrogen under pressure, or the known method employing the injection of an incompressible fluid under pressure, or a circular tool composed of a plurality of adjacent sectors which are movable in a direction perpendicular to the axis of the can, or an inflatable cushion of a elastomer.

All these expanding methods are known methods and are therefore not described in detail.

The expansion conditions are so determined that the heights H1 and H2 of the regions 2A and 2B remain identical and the thickness of the wall portions of the peripheral wall 2 remains constant.

After this operation unfolding the controlled accordion folds 4 and 5 of the peripheral wall 2, a shaped can is obtained which comprises two geometrically expanded regions 2A and 2B the expansion ration of which, calculated with the formula:

$$\frac{\text{final } D - \text{initial } D}{\text{initial } D} \times 100$$

is about 3% in the case of a preliminary can obtained by drawing and ironing a metal blank of steel and about 8% in the case of a preliminary can obtained by drawing and redrawing a metal blank of steel.

Indeed, if there is taken a ring of height H1 for example of the preliminary can 3, the wall of this ring being cylindrical, the area of available metal on a generatrix is:

$$S1=H1\times e$$

e being the thickness of the wall of the ring.

The volume of metal available in the considered ring is:

$$V1=S1\times\pi\times D,$$

D being the diameter of the ring.

After having effected the folding in the form of folds of an accordion of the region of the peripheral wall 2 to be geometrically expanded, the ring of height H1 has a wall of a generally sinusoidal shape whose thickness e is equal to that of the wall of the cylindrical ring of the preliminary can 3.

In this case, the area S2 of available metal exceeds S1, the profile having changed from a straight profile to a profile having a generally sinusoidal shape and the height having remained identical.

In view of the fact that the mean diameter of the ring remained identical and equal to D, the volume V2 of metal available in the considered ring is:

$$V2=S2\times\pi\times D$$

this volume V2 being greater than V1.

When the ring of height H1 is unfolded by means of an expansion tool, the profile of the wall of the ring is brought back to a rectilinear profile and this occurs without increasing the height H1.

In this case, the area S3 of metal available on a generatrix is also equal to H1×e, that is, equal to S1 since the expansion conditions were such that the thickness e of the wall of the ring has undergone no evolution or only a slight evolution.

The volume V3 of metal available in the ring after unfolding is:

$$V3=S3\times\pi\times D3$$

D3 being the diameter of the expanded ring.

Now, bearing in mind the fact that S1=S3 and that the volume of metal remains identical V2=V3, we have the following equation:

$$S2\times\pi\times D=S3\times\pi\times D3$$

that is $$S2\times D=S3\times D3=S1\times D3$$

now, as S2>S1, we therefore have D3>D.

The final diameter D3 of each geometrically expanded region 2A and 2B is therefore directly related to the profile of each accordion fold 4 and 5 and therefore to the depth of the grooves 6.

The possible ration of expansion is however limited by the feasibility of grooves 6 without decreasing the thickness of the peripheral wall 2 in said grooves.

At the present time with the available tools, the maximum ratio of expansion for a drawn and ironed steel can may reach 3 to 4% and for a drawn and redrawn steel can 8 to 10%.

In an alternative manner of proceeding (not shown), for producing the controlled folding in the form of folds of an accordion of the peripheral wall 2 on the whole of the height of each region 2A and 2B to be geometrically expanded, a helical groove may be produced instead of a series of adjacent grooves 6.

In this case, the helical groove is produced in commencing in the part of the region to be geometrically expanded which is the closest to the bottom and ending in the part of the region to be geometrically expanded the furthest from the bottom.

The helical groove has a variable depth.

As shown in FIG. 5, it is also possible to produce a shaped can having at least one region 2D whose diameter is less than that of the remainder of the can.

In this case, the procedure is the same as before for producing a controlled folding in the form of folds of an accordion of the peripheral wall 2 on the whole of the height of the region 2D to be formed so as to increase the volume of metal available in this region.

Thereafter, the accordion folds are unfolded toward the interior of the peripheral wall 2.

The process for manufacturing shaped cans according to the invention permits producing shaped cans with more pronounced bulges or curves and permits using preliminary cans obtained by drawing and ironing or drawing and redrawing.

What is claimed is:

1. Process for manufacturing a shape metal beverage can comprising a bottom and a cylindrical peripheral wall which is in one piece with said bottom and includes at least one geometrically expanded region and is adapted to receive a lid to be set on said peripheral wall, said process comprising the following steps:

producing a preliminary beverage can comprising a bottom and a cylindrical peripheral wall which is in one piece with said bottom, effecting in at least one region to be geometrically expanded of said peripheral wall of said preliminary can a controlled folding in the form of folds of an accordion on the whole of the height of said at least one region to be geometrically expanded for increasing the volume of metal available in said at least one region, unfolding said folds to obtain said at least one geometrically expanded region wherein no or limited thinning down of the peripheral wall occurs upon unfolding.

2. Process according to claim 1, comprising unfolding said folds towards the exterior of said peripheral wall of said preliminary can.

3. Process according to claim 1, for producing on said peripheral wall of said shaped can at least two geometrically expanded regions, comprising first of all forming the geometrically expanded region which is the closest to said bottom of said preliminary can and then the geometrically expanded region which is the furthest from said bottom of said preliminary can.

4. Process according to claim 1, comprising effecting said controlled folding by forming a series of grooves which are adjacent to one another by commencing in the part of said at least one region to be geometrically expanded which is the closest to said bottom of said preliminary can and ending in the part of said at least one region to be geometrically expanded which is the furthest from said bottom of said preliminary can.

5. Process according to claim 4, wherein the depth of each groove is a function of the final diameter to be obtained in said at least one geometrically expanded region in the region of the corresponding groove.

6. Process according to claim 4, comprising producing said groove generatrix by generatix by turning a tool around said peripheral wall of said preliminary can.

7. Process according to claim 1, comprising effecting said controlled folding by forming a helical grove in commencing in the part of said at least one region to be geometrically expanded which is the closest to said bottom of said preliminary can and ending in the part of said at least one region to be geometrically expanded which is the furthest from said bottom.

8. Process according to claim 7, wherein said helical groove has a variable depth.

9. The process according to claim 1, wherein said preliminary beverage can comprises drawn and ironed steel, and wherein said geometrically expanded region has a ratio of expansion of from 3–4%.

10. The process according to claim 9, wherein no thinning down of the peripheral wall occurs upon unfolding.

11. The process according to claim 1, wherein said preliminary beverage can is made from drawn and redrawn steel, and wherein said geometrically expanded region has a ratio of expansion of from 8–10%.

12. The process according to claim 11, wherein no thinning down of the peripheral wall occurs upon unfolding.

13. The process according to claim 1, wherein no thinning down of the peripheral wall occurs upon unfolding.

14. The process according to claim 1, comprising unfolding said folds towards the interior of said peripheral wall of said preliminary can.

* * * * *